United States Patent [19]

Hoffman et al.

[11] 4,359,852

[45] Nov. 23, 1982

[54] SEALED MOISTUREPROOF CONTAINER

[75] Inventors: Louis S. Hoffman, Morristown; Susan L. Kurlander, Hoboken, both of N.J.

[73] Assignee: H. P. Hood, Inc., Boston, Mass.

[21] Appl. No.: 181,154

[22] Filed: Aug. 25, 1980

[51] Int. Cl.[3] ..... B65B 7/28; B65B 53/06

[52] U.S. Cl. ..... 53/420; 53/442; 53/471; 53/488; 206/306; 206/359

[58] Field of Search ..... 53/419, 420, 422, 442, 53/471, 488; 220/306, 359

[56] References Cited

U.S. PATENT DOCUMENTS

| | | | |
|---|---|---|---|
| 1,951,567 | 3/1935 | Spear | 53/420 |
| 3,148,103 | 9/1964 | Gallagher | 220/306 X |
| 3,197,940 | 8/1965 | Spangler | 53/488 X |
| 3,396,899 | 8/1968 | Strouse | 220/359 |
| 3,522,124 | 7/1970 | Peyraud | 53/488 X |
| 3,561,668 | 2/1971 | Bergstrom | 220/359 X |
| 4,000,816 | 1/1977 | Spruyt | 220/359 X |

*Primary Examiner*—John Sipos

*Attorney, Agent, or Firm*—Robert T. Gammons

[57] ABSTRACT

A moistureproof package comprising a container and lid characterized in that the lid is attached to the container by means of a primary hermetic seal and is provided with a secondry snap fastener for securing the lid to the container once it has been opened, and further characterized in that the container and lid frame are formed from a single sheet of material enough larger in area than that required to form the container to also form the lid frame.

24 Claims, 15 Drawing Figures

SEALED MOISTUREPROOF CONTAINER

BACKGROUND OF THE INVENTION

This invention is concerned with the making of a sealed moistureproof package in the form of a container and hermetically-sealed lid wherein the lid is structured so that the seal can be easily broken and the lid readily removed without destruction or distortion and can therefore be replaced.

SUMMARY OF THE INVENTION

As herein illustrated, the moistureproof package according to this invention comprises a container having an open end peripherally of which there is an outwardly-extending end flange and a removable lid applied to the open end comprising a surrounding structure positioned peripherally of the end flange having outwardly and inwardly-extending flanges, the outwardly-extending flange lying in the plane of the end flange and the inwardly-extending flange lying below the end flange and a film sheet bonded to the end flange and to the outwardly-extending flange of the surrounding structure with a bond between the film sheet and the outwardly-extending flange which is greater than the bond between the film and the end flange so that by grasping the lid and pulling upwardly thereon to disengage the inwardly-extending flange from beneath the end flange, the bond between the film and the end flange can be broken and the film peeled away from the end flange to release the lid from the top of the container.

As herein illustrated, the moistureproof package is made by forming at the open end of the container a flange structure comprising a first flange connected at its proximal edge to the open end and a second outwardly-extending flange connected at its proximal edge to the distal edge of the first flange in spaced, parallel relation thereto and severing the first flange intermediate its proximal and distal edges to separate from the open end a surrounding hollow structure comprising the outwardly-extending second flange and a portion of the first flange, leaving the remainder of the first flange at the open end of the container in the form of an end flange. The hollow structure constitutes a lid frame. The container is then filled with the material to be packaged therein, a sheet of heat shrinkable material positioned across the lid frame and heat-sealed or adhesively attached to the outwardly-extending second flange, whereupon the container and lid frame with the heat-shrinkable sheet attached thereto are so positioned relative to each other that the end flange and the outwardly-extending second flange of the lid frame lie in a common plane. Heat is now applied to the heat-shrinkable film sheet to shrink it in the plane of the outwardly-extending flange of the lid frame to cause portions of the first flange connected thereto to be drawn into engagement with the underside of the end flange, whereupon the film sheet is attached by heat sealing or adhesive to the end flange. Simultaneously or thereafter, a semirigid cover board is heat-sealed or adhesively attached to that portion of the film sheet attached to the outwardly-extending second flange. The film sheet is so attached as to provide a hermetic seal and to provide a stronger bond between it and the second outwardly-extending flange then between it and the end flange so that the lid can be removed without destruction. Desirably, the container and lid frame are formed of a single sheet of material slightly larger in area than the area required to form the container in a single operation with the aid of a die containing a first cavity corresponding in configuration to the container and a second cavity corresponding in configuration to the lid frame. Preferably, the method is carried out as a production line operation wherein the containers are formed in a double row, filled and closed, whereupon the side-by-side containers are separated from each other by severing.

The invention will now be described in greater detail with reference to the accompanying drawings, wherein.

Figure 1:
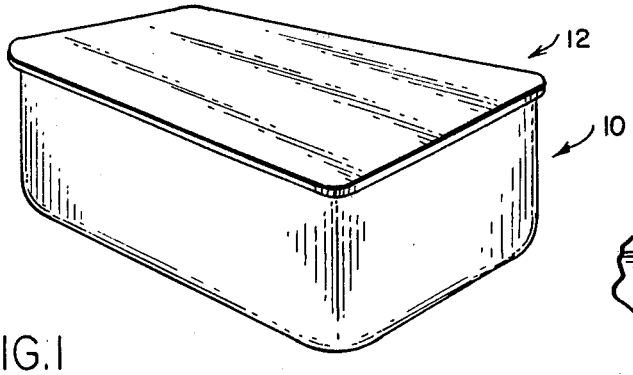
FIG. 1 is a perspective view of a moistureproof package made according to this invention.

Referring to the drawings, the package as illustrated in FIG. 1 comprises a receptacle 10 of generally rectangular, horizontal and vertical section to which there is applied a closure or lid 12, the latter being adapted, as will appear hereinafter, to seal the package until its contents are to be used and so designed that once the seal is broken, it may be removed to permit removal of the contents and replaced if all of the contents are not used. A hermetic seal is provided.

The receptacle 10 itself is of molded construction having a flat bottom wall 14, spaced, parallel side walls 16—16 and spaced, parallel end walls 18—18. Ribbing, not shown herein, may be molded into the sides and end walls to provide strength. A thermoformable thermoplastic is used for making the receptacle. At the top of the receptacle there is a peripheral end flange 20 which extends all the way around.

Figure 5:
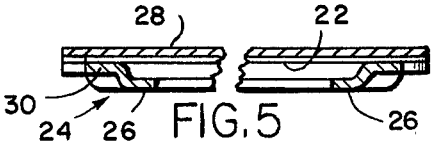
FIG. 5 is a transverse section of the closure for the package, the longitudinal section being the same.
Figure 6:
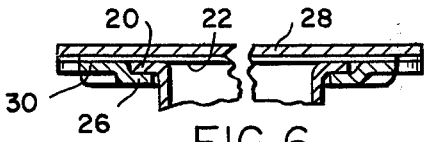
FIG. 6 is a fragmentary section of the package with the closure applied thereto.

The closure or lid, FIGS. 5 and 6, comprise a hollow, substantially rectangular lid frame 24 provided with an outwardly-extending flange 30 to which is attached a heat-shrinkable, flexible, moistureproof sheet 22 of plastic material and an inwardly-extending flange 26 for engagement with the underside of the end flange 20 at the top of the receptacle. A semirigid cover board 28 is attached to that portion of the top side of the sheet 22 overlying the outwardly-extending flange 30. In the closed condition of the package, portions of the inwardly-extending flange 26 of the lid frame underly and engage the underside of the end flange 20 and the sheet 22 is bonded to the outwardly-extending flange 30 and to the end flange 20. The bond between the sheet 22 and the end flange 20 is purposely made weaker than the bond between the sheet 22 and the outwardly-extending flange 30 so that the lid can be removed from the top of the container without destroying its integrity. The bonds between the sheet material and the respective flanges 20 and 30 may be formed by heat-sealing, heat-activated adhesive applied to the film sheet or flanges, or pressure-sensitive adhesive.

As thus constructed, the package can be readily opened to provide access to its contents by grasping an edge of the lid, flexing it upwardly to disengage the flange 26 from the flange 20 and peeling the sheet 22 away from the flange 20. By providing a bond of lesser strength between the sheet 22 and the end flange 20, there is no danger of the sheet 22 and the superimposed cover board 28 being separated from the structure 24. Thus, the lid, although peeled away from the open top of the container, is intact and may be restored so as to cover the open top in the event that the entire contents are not used and it is desirable to use the remainder at some future time. There is, in fact, a sufficient elasticity in the plastic of which the container and lid are comprised so that the flanges 20 and 26 can be readily engaged and disengaged to on the one hand release the lid and on the other hand reattach it and, when reattached, to provide a relatively tight seal.

Figure 7:
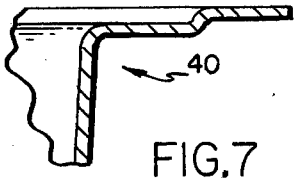
FIG. 7 is an enlarged fragmentary section at the top of the moistureproof package showing the formation of the flange structure at the top.
Figure 2:
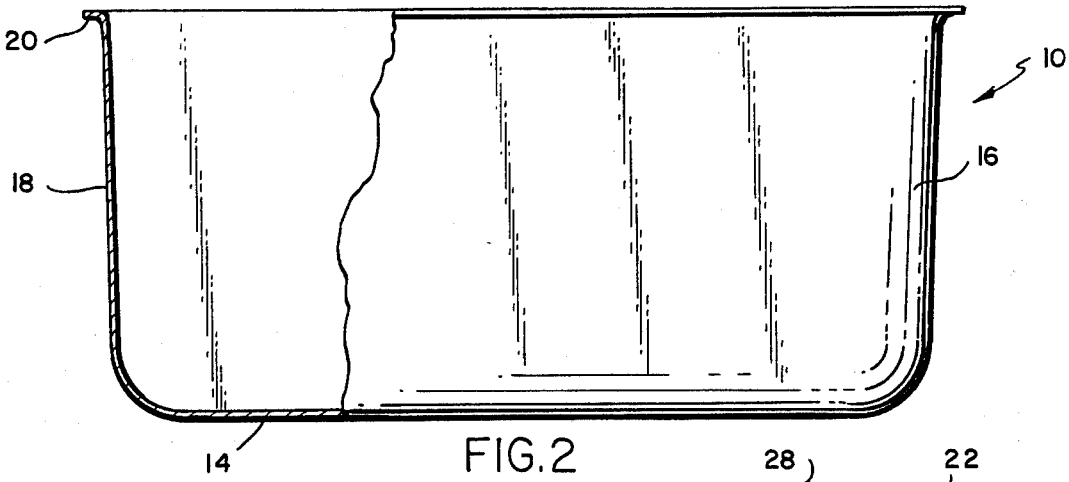
FIG. 2 is an elevation of one side of a moistureproof package shown in FIG. 1 to larger scale with a portion of the side wall broken away.
Figure 3:
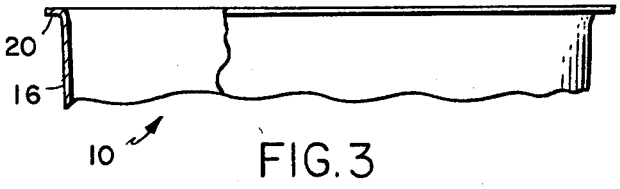
FIG. 3 is a fragmentary elevation of an end of the moistureproof package shown in FIG. 1 to larger scale with a portion of the end wall broken away.
Figure 4:
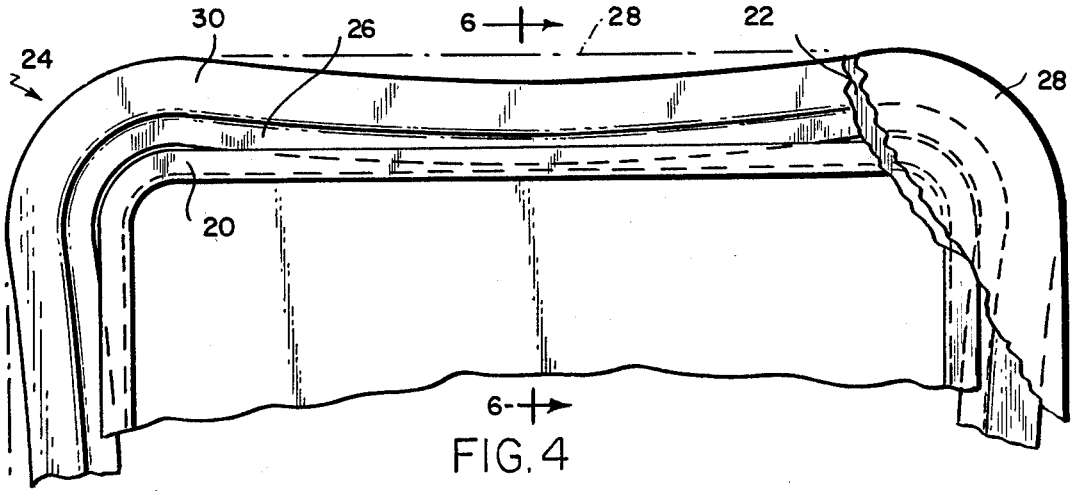
FIG. 4 is a fragmentary plan view of the top of the moistureproof package with portions of the lid broken away to show the engagement of the lid flange with the end flange of the package.
Figure 8:
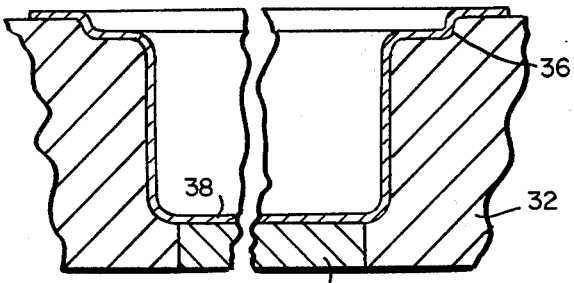
FIG. 8 is a section of the first step of forming the package wherein a flange structure is formed about the open end.
Figure 9:
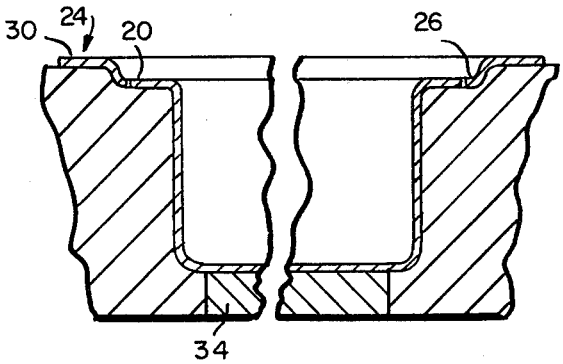
FIG. 9 is the second step wherein the flange structure is severed.
Figure 10:
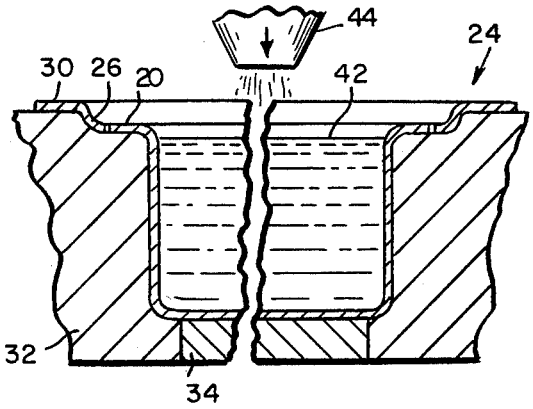
FIG. 10 is the third step wherein the package is filled with the material to be sealed therein.
Figure 11:
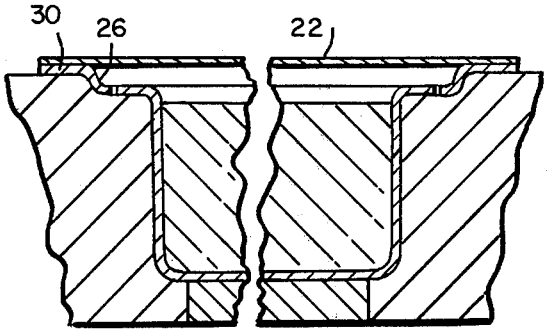
FIG. 11 is the fourth step wherein a cover sheet is placed across the open top.
Figure 12:
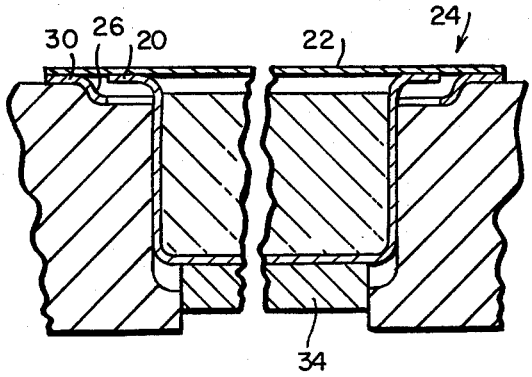
FIG. 12 is the fifth step wherein the container is raised into engagement with the underside of the cover sheet.
Figure 13:
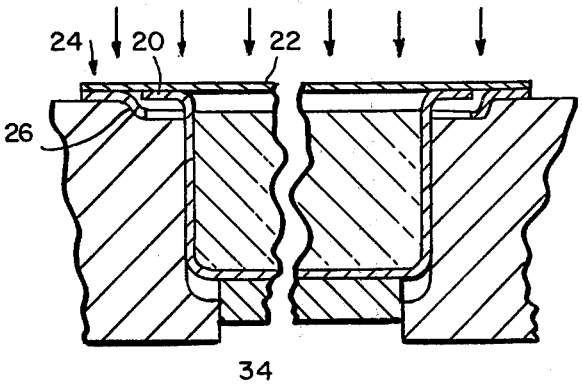
FIG. 13 is the sixth step wherein the cover sheet is subjected to heating to effect shrinkage.
Figure 14:
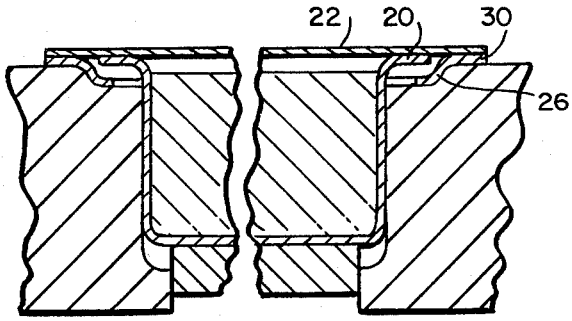
FIG. 14 is the seventh step wherein a seal is made between the cover sheet and the flange at the open top of the container.
Figure 15:
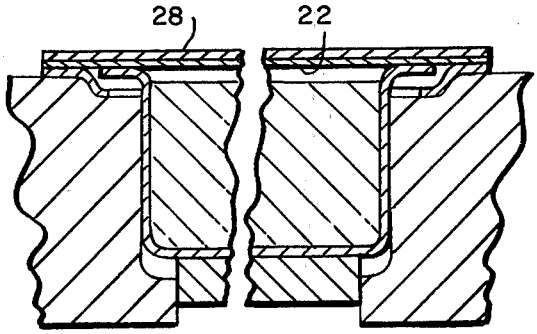
FIG. 15 is the eighth step wherein a cover board is adhesively applied to the cover sheet.

The package is vacuum formed with the aid of a die comprising stationary and movable parts 32 and 34 as shown in section in FIGS. 8 to 15 inclusive, the parts 32 and 34 containing cavities 36 and 38 structured to provide as the initial step in the method of making the package an integral structure, the body of the receptacle comprising the bottom 14, side walls 16—16 and end walls 18—18 and an integral flange structure 40, FIG. 7, at the top which ultimately provides for the end flange 20 and the lid frame 24 comprising the inwardly-extending flange 26 and the outwardly-extending flange 30. After the sheet material of which the receptacle is to be constructed is formed into the die cavities 36 and 38, the flange structure 40 is severed, as shown in FIG. 9, to separate from the open top of the receptacle the hollow lid frame 24 comprising the outwardly-extending flange 30 and the inwardly-extending flange 26, leaving about the open top of the receptacle the outwardly-extending end flange 20. As a third step in the operation, the receptacle is now filled with the material 42 to be packaged therein through a filling member 44, whereupon, as shown in FIG. 11, the film sheet 22 is placed across the open top of the receptacle and attached to the outwardly-extending flange 30 by heat-sealing, heat-activated adhesive or pressure-sensitive adhesive as best suited for the purpose for which the package is to be used. Now, as shown in FIG. 12, the movable portion 34 of the die is raised to lift the receptacle upwardly with respect to the surrounding lid frame 24 and the film sheet 22 attached thereto so as to bring the outwardly-extending end flange 20 into the plane of the flange 30 and into engagement with the underside of the film sheet 22. Heat is now applied to the surface of the film sheet as shown in FIG. 13 which is comprised of a heat-shrinkable material to cause shrinking in its plane and to thus contract the lid frame 24 so as to draw portions of the four sides or two of the four sides of the lid frame 24 inwardly to thus engage a portion of the inwardly-extending flange 26 beneath the outwardly-extending end flange 20 as shown in FIG. 4. Film sheet 22 is now attached to the end flange 20 by heat-sealing, heat-activated adhesive or pressure-sensitive adhesive, but with a weaker bond than the bond between the film sheet material and the outwardly-extending flange 30. At the same time or thereafter, the cover board 28 is attached to the upper side of the film sheet 22, thus completing the package and providing a primary hermetic seal and a secondary snap fastener to on the one hand provide for long shelf life before the container is opened and on the other hand after it has been opened to reapply the lid to preserve the contents of the container in the event that the contents have not all been used.

Desirably, the container and lid frame are formed from a single sheet of material just enough larger in area than that required to form the container to provide for forming the lid frame.

The receptacle 10, as previously stated, is comprised of a thermoformable thermoplastic material such as high impact polystyrene, polyethylene, polypropylene and polyvinyl chloride. The heat-shrinkable, moistureproof sheet is selected so as to provide controlled shrinkage, to be compatible with the container material and to afford suitable barrier characteristics. Composite film structures may be used in which the sheet consists of multiple layers of different films. Films embodying the characteristics desired comprise polyesters, polyethylene, polyvinyl chlorides, polyvinyledene chlorides, ionomers (Dupont Surlyn) and polypropylenes. A semirigid paperboard which is sufficiently strong to bear the weight of stacking and is receptive of decoration and legends denoting the manufacturer and content are used for the cover board.

Desirably, the receptacles are made on a production line basis, the successive steps being carried out seriatum and with two lines of receptacles side-by-side which are separated from each other at the end of the operation.

It should be understood that the present disclosure is for the purpose of illustration only and includes all modifications or improvements which fall within the scope of the appended claims.

We claim:

1. The method of making a moistureproof package comprising forming at the open upper end of a container a flange structure comprising a first flange connected at its proximal edge to the open end of said container and a second flange connected at its proximal edge to the distal edge of the first flange, the major part of said second flange lies in a plane parallel and above the plane of the major part of the first flange, severing the first flange intermediate its proximal and distal edges to separate from the open end a surrounding hollow structure comprising the second flange and a portion of the first flange, leaving the remainder of the first flange at the open end of the container in the form of an end flange at the open end of the container, moving the container and separated surrounding structure relative to each other so that said end flange and the second flange lie in a common plane and said portion of the first flange lies below the plane of said end flange, attaching a film sheet deposited across the open end of the container to the second flange and effecting shrinkage of the film sheet in the plane of the second flange sufficiently to cause portions of the first flange connected thereto to be drawn into engagement with the underside of the end flange.

2. A method according to claim 1 comprising, after effecting shrinkage of the film sheet, attaching the film sheet to the end flange.

3. A method according to claim 1 comprising filling the container with the material to be packaged prior to positioning the film sheet across the open end thereof.

4. A method according to claim 1 comprising filling the container with the material to be packaged prior to applying the film sheet thereto and thereafter positioning the film sheet across the open end and attaching it to the second flange.

5. A method according to claim 1 comprising attaching a semirigid cover board to the upper side of the film sheet.

6. A method according to claim 1 comprising forming the container and the flange structure in the cavity of a die and while supporting the flange structure, severing the first flange intermediate its proximal and distal edges.

7. A method according to claim 1 comprising while supporting the separated surrounding structure, moving the container upwardly relative thereto to bring the end flange into engagement with the film sheet and attaching the end flange to the film sheet.

8. A method according to claim 1 comprising attaching the end flange to the film sheet with a weaker bond than the bond between the second flange and the film sheet.

9. A method according to claim 7 comprising positioning the film sheet over the open end of the container which is coextensive with the area defined by the outer dimensions of the second flange and attaching the same to the second flange.

10. A method according to claim 8 comprising moving the container relative to the separated surrounding structure to bring the end flange into the plane of the second flange and into engagement with the underside of the film sheet and attaching the end flange to the film sheet.

11. A method according to claim 1 wherein the film sheet is attached to the second flange by heat-sealing.

12. A method according to claim 1 wherein the film sheet is attached to the second flange by heat-activated adhesive.

13. A method according to claim 1 wherein the film sheet is attached to the second flange by pressure-sensitive adhesive.

14. A method according to claim 2 wherein the film sheet is attached to the end flange by heat-sealing.

15. A method according to claim 2 wherein the film sheet is attached to the end flange by heat-activated adhesive.

16. A method according to claim 2 wherein the film sheet is attached to the end flange by pressure-sensitive adhesive.

17. A method according to claim 5 wherein the semirigid cover board is attached to the film sheet by heat-sealing.

18. A method according to claim 5 wherein the semirigid cover board is attached to the film sheet by heat-activated adhesive.

19. A method according to claim 5 wherein the semirigid cover board is attached to the film sheet by pressure-sensitive adhesive.

20. A method according to claim 5 wherein the semirigid cover board is attached to that portion of the film sheet having contact with the second flange.

21. A method according to claim 2 comprising attaching the film sheet to the end flange by means such as to form a hermetic seal.

22. A method of making moistureproof packages comprising successively forming open-top receptacles comprising rectangularly arranged side walls and a bottom wall with outwardly-extending flange structures at their open tops, said flange structures comprising a first flange connected at its proximal edge to the open end of said container and a second flange connected at its proximal edge to the distal edge of the first flange, the major part of said second flange lies in a plane parallel and above the plane of the major part of the first flange, severing the first flanges intermediate their proximal and distal edges to separate them from the open tops surrounding hollow structures comprising the second flange and a portion of the first flange, leaving the remainder of the first flanges at the open tops of the containers in the form of an end flange at the open tops of the containers, filling the containers with the contents to be packaged therein, positioning film sheets across the open tops of the containers in engagement with the second flanges, attaching the film sheets to the second flanges, moving the containers and separated surrounding structures relative to each other so that the end flanges and the second flanges lie in a common plane and said portions of the first flanges lie below the plane of said end flanges, shrinking the film sheets in the plane of the second flanges sufficiently to cause said portions of the first flanges connected thereto to be drawn into engagement with the underside of the end flanges and attaching the film sheets overlying the end flanges thereto.

23. A method according to claim 22 comprising attaching semirigid cover boards to the film sheet.

24. A method according to claim 22 comprising forming two lines of containers side-by-side and severing them from each other following completion.

* * * * *